US005971026A

United States Patent [19]

Beran

[11] Patent Number: 5,971,026

[45] Date of Patent: Oct. 26, 1999

[54] INTERNAL GEOMETRY SHAPE DESIGN FOR VENTURI TUBE-LIKE GAS-AIR MIXING VALVE

[75] Inventor: Zdenek Beran, Prague, Czech Rep.

[73] Assignee: Honeywell Inc.

[21] Appl. No.: 08/987,335

[22] Filed: Dec. 9, 1997

[51] Int. Cl.[6] ..... G05D 11/03

[52] U.S. Cl. ..... 137/888

[58] Field of Search ..... 137/269, 271, 137/888, 889, 890, 891, 892, 893

[56] References Cited

U.S. PATENT DOCUMENTS

| | | | |
|---|---|---|---|
| 1,195,915 | 8/1916 | Damrow | 137/888 X |
| 2,361,150 | 10/1944 | Petroe | 137/888 X |
| 2,424,654 | 7/1947 | Gamble | 137/892 X |
| 2,953,160 | 9/1960 | Brazier | 137/892 X |
| 3,643,688 | 2/1972 | Meinert | 137/891 X |
| 3,684,189 | 8/1972 | Reed et al. . | |
| 4,845,952 | 7/1989 | Beebe . | |
| 4,966,001 | 10/1990 | Beebe . | |
| 5,002,481 | 3/1991 | Forster . | |
| 5,140,820 | 8/1992 | Booz . | |
| 5,257,499 | 11/1993 | Leonard . | |
| 5,402,633 | 4/1995 | Hu . | |
| 5,450,724 | 9/1995 | Kesseli et al. . | |
| 5,477,671 | 12/1995 | Mowill . | |
| 5,572,862 | 11/1996 | Mowill . | |
| 5,611,684 | 3/1997 | Spielman . | |

FOREIGN PATENT DOCUMENTS 395763B 3/1993 Austria .

OTHER PUBLICATIONS

JP 10–227418 A (Haman KK) Aug. 25, 1998 (25.08.98), Abstract.

Us 4009988 A (Lincoln Brass Works) Mar. 1, 1977 (01.03.77), Abstract.

*Primary Examiner*—Stephen M. Hepperle
*Attorney, Agent, or Firm*—John G. Shudy, Jr.

[57] ABSTRACT

A gas-air mixing valve using a tube. The valve has an internal geometry shape for directing the flow of air and gas, including an air inlet, an inlet part from the inlet to a throttle, a gas inlet slot proximate the throttle, and an outlet. The inlet part has a first body part, preferably of aluminum or other metal, and a replaceable molded part normally of plastic. The first body part has an inlet surface centered about a central axis defined by a concave surface having a first circular cross section. The replaceable molden part has a composite surface defined by conical surface defined by conical surface having a linear cross section and further defined by a convex surface having a second circular cross section forming the throttle. The replaceable molden outlet part has a conical surface extending from the second circular cross section to a second convex surface at the outlet. The throttle has a radius with respect to the central axis of the valve defined by the relationship between the desired air flow and radius for a particular pressure drop. The gas slot has a thickness with respect to the desired gas flow defined by the relationship between the desired gas flow and gas slot for a particular pressure drop. Both relationships are computer simulated using parameters of the system for which the valve is intended to be used.

14 Claims, 5 Drawing Sheets

INTERNAL GEOMETRY SHAPE DESIGN FOR VENTURI TUBE-LIKE GAS-AIR MIXING VALVE

FIELD OF THE INVENTION

The present invention relates to a multiple capacity Venturi gas-air mixing valve. More particularly the invention relates to an internal geometrical shape design for a tube-like gas-air mixing valve.

BACKGROUND OF THE INVENTION

The invention relates generally to a multiple capacity gas-air mixing valve including an internal geometrical shape design for a tube-like gas-air mixing valve. The output of the valve is combusted in a downstream combustion device such as a boiler.

Related art gas-air mixing valve have particular inlet parts for gas-air mixing at particular capacities and drop pressures. These parts are typically designed by trial and error. For each trial, both inlet and outlet plastic parts, mounted in an aluminum body, have to be completely manufactured and tested, thus making the design process slow and expensive. Moreover, the efficiency of the resultant shape is not always satisfactory.

Most of the prior art relating to gas-air mixing relates generally to gas turbines, not to inlets for boilers. Spielman U.S. Pat. No. 5,611,684 relates generally to the field of use of the subject invention. In this patent, a gaseous fuel and combustion air are premixed. There is, however, no disclosure of a type mixing valve.

Leonard U.S. Pat. No. 5,257,499 employs a between the fuel introduction means and the air introduction means, such that the air flow is relatively constant over a large range of fuel flow rates. Both Mowill U.S. Pat. Nos. 5,477,671 and 5,572,862 disclose a having an inlet and an axis, where the inlet is operatively connect to the source of compressed air to define a compressed air flow path into the inlet. In essence these patents disclose the concept of using a separate from the combustion chamber to completely premix the fuel and air.

Forster U.S. Pat. No. 5,002,481 premixes heating oil by vaporization in steam rather than air. The vaporizing tubes of the second vaporizing portion have a smaller radius of curvature than the first as vaporization occurs in downwardly directed helical pipes. The resultant mix is discharged directly into a mixing space.

U.S. Pat. Nos. 4,845,952 and 4,966,001 (both to Beebe) also use tubes for mixing fuel by placing the tubes in the air flow path. These patents employ a multiple-venture tube pre-mix apparatus.

Hu U.S. Pat. No. 5,402,633 discloses a premix gas nozzle with a longitudinal tangential entrance slots. Kesseli U.S. Pat. No. 5,450,724 uses a plurality of mixing channels that are oriented to impart a swirling motion to the mixed combustion air and fuel. Finally, Booz U.S. Pat. No. 5,140,820 relates to a carburation system for small scale engines but is stated to be usable in larger engines and even auxiliary power units. It does not disclose a valve means.

The manufacturer of gas-air mixing valves is faced with a range of customers that is greatly diverse and requires a custom design for many of the boilers serviced by the valve manufacturer. With many boiler manufacturers and an almost unlimited number of applications for the boilers, the permutations of valve designs is equally immense. At the same time, each user of the boiler wants maximum efficiency, minimum pollution or unburned fuel, minimum cost and prompt, virtually immediate service and response to its demands for new valves.

The problem that exists is that a number of factors are important in the design process for making mixing valves. Previous to the present invention, valve parts were designed by experience, using trial and error methods that led to high design expense or less than optimum results. For each trial, both the inlet and outlet parts, which are made from plastic and mounted in an aluminum body, had to be completely manufactured and tested. This made the design process very slow and quite expensive. Moreover, the efficiency of the developed shape was not always satisfactory for the many different end uses.

Venture principle based gas-air mixing valves are employed in a multitude of boiler systems, particularly with industrial boilers that produce large quantities of energy for various industrial processes and applications. A large number of mixing valve characteristics need to be considered during the design of the valve. It is necessary to meet the requirements for air discharge, gas discharge, gas/air volume proportion for different fan loads, pressure drop along the valve, modulation band, maximal angle of the outlet part, and the like.

For example, in one industrial application where a large number of valves are produced, a pressure drop may range from less than 350 Pascals to more than 550 Pascals. at the same time, desired air capacities range from 18 to 66 cubic meters per hour ($m^3/h$) and the accompanying gas capacities for that range of air flow.

It would be of great advantage to provide a general inner shape profile for a gas-air mixing valve that would optimize the most important valve characteristics for a family of valves. These characteristics include gas/air volume proportion along different fan load, modulation band, which strongly determine valve overall efficiency.

It would be another great advance in the art if the required gas and air capacities could be accommodated by a valve having a particular shape profile for optimum results.

Another advantage would be if the outlet part of the valve would be configured to maximize the overall operation of the valve.

Other advantages will appear hereinafter.

SUMMARY OF THE INVENTION

It has now been discovered that the above and other objects of the present invention may be accomplished in the following manner. Specifically, the present invention provides an internal geometrical shape design for a Venture tube-like gas-air mixing valve. The output of the valve is combusted in a downstream combustion device such as a boiler. The valve of the present invention is selected to operate with such a boiler or other combustion device, which device determines the range of gas and air flow rates needed to operate efficiently over the operating range of the boiler. Once these parameters are selected, the valve itself is determined by the method of this invention.

The present invention involves an internal geometrical shape design for a tube-like gas-air mixing valve. This invention not only enables one to achieve optimal computer provided efficiency, but also is used to facilitate integration of a plastic inlet part with the aluminum body which is unchanged over a range of various valve capacities and pressure drops. The inlet part of the valve is made by extrusion from an appropriate plastic material. The same metal valve body is used for a whole variety of mixing valves by changing only relatively simply manufactured plastic parts designed for certain gas-air mixing parameters.

A gas-air mixing valve of the present invention has an adjustable air inlet that is fixed by adjusting the radius of the throttle admitting air to the mixing portion of the valve. The gas inlet is also adjusted, based on the desired operating conditions of the valve. The internal geometry shape for directing the flow of air and gas in the valve defines that flow. The inlet part is formed with a more permanent body part, such as one made from aluminum, and a replaceable molded part, made from plastic. The first body part has an inlet surface centered about a central axis defined by a concave surface having a first circular cross section. The replaceable molden part has a composite surface defined by a conical surface having a linear cross section and further defined in part by a convex surface having a second circular cross section forming the throttle. As noted above, the mixing valve of this invention functions by adjusting the proportion of gas and air using the principles of venturi action. The terms "convex" and "concave" as used above are, of course, surfaces of the cross section with respect to said central axis.

The replaceable outlet part of the valve has a composite outlet surface defined by a first conical surface extending from the above mentioned second circular cross section of the first body part to a second convex surface on the outlet part, such that the second convex surface acts as a flared surface for the outlet of the valve.

Based upon the desired air and gas flow characteristics and the demands of the boiler and system for which the valve is intended, the specifics of the valve such as air throttle opening (which fixes the air volume) and gas inlet size (which fixes the gas volume) may be optimized for each application of the valve. The only part that needs to be adjusted for the completed valve is the replaceable molded plastic part.

BRIEF DESCRIPTION OF THE DRAWINGS

For a more complete understanding of the invention, reference is hereby made to the drawings, in which.

DETAILED DESCRIPTION OF THE PREFERRED EMBODIMENT

The invention involves an internal geometric shape for a component of a gas-air mixing valve. The valve itself is based on the principle and includes a structure that can be made with a simple fabrication process while maintaining the postulated characteristics of the valve.

The mixing valve has certain required characteristics relevant to air discharge, gas discharge, gas/air volume proportions for different fan loads, pressure drops along the valve, modulation band and the maximum angle of the outlet part. For the preferred embodiment as described herein, preferred pressure drops are 350, 450 and 550 Pascals, respectively. The air capacities are within the range of 18–66 cubic meters per hour ($m^3/h$) which are accompanied by the respective gas capacities. Of course, other pressure drop ranges and air capacities will be selected for other boilers, fan, and system variables.

Taking into account the needed specifications, the general inner shape profile is designed in order to achieve the most important valve characteristics, which are gas/air volume proportions for different fan loads, and the modulation band, and these strongly determine overall valve efficiency.

Figure 1:
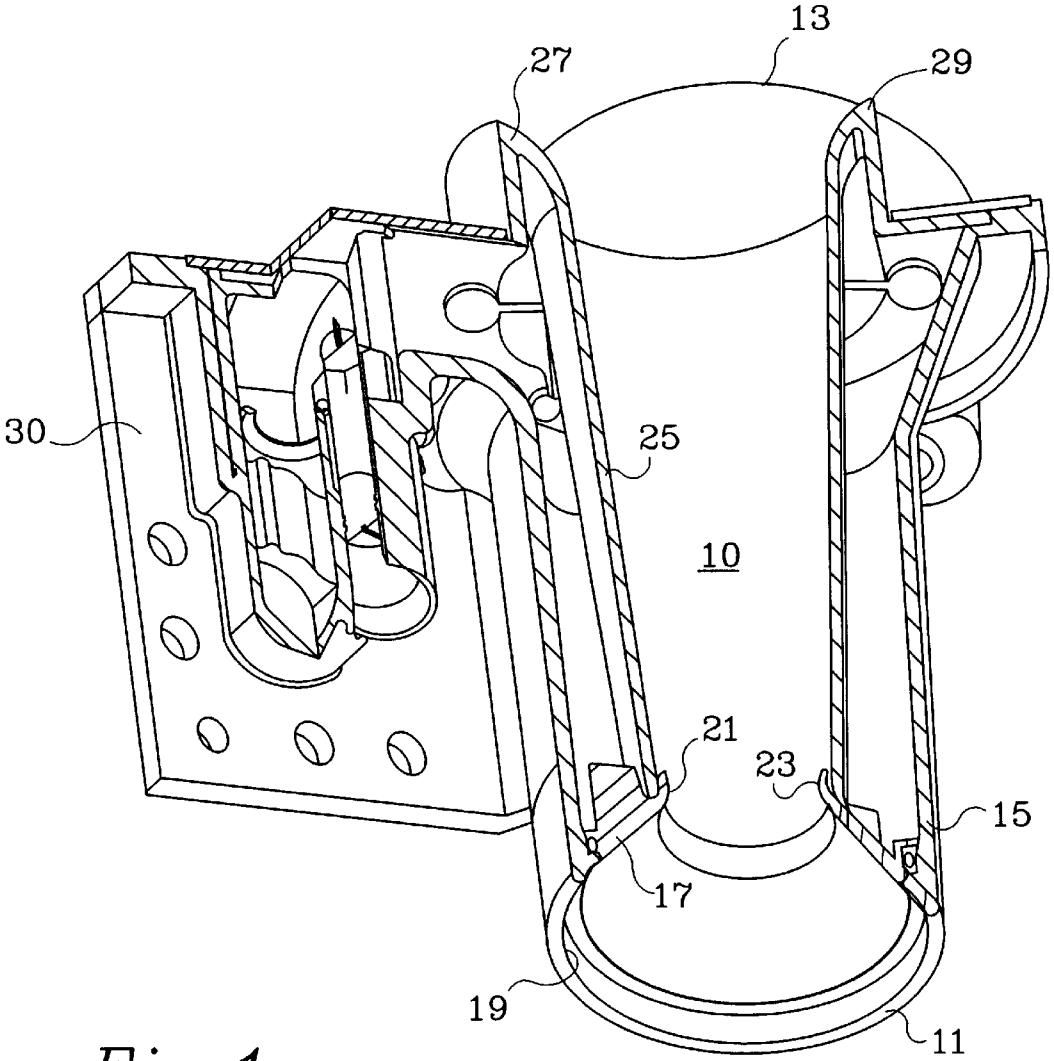
FIG. 1 is a schematic, sectioned view illustrating the valve of the present invention.

Shown in FIG. 1 illustrates a portion of an integrated gas/air control safety system with fan and a Valve 10 generally, having an inlet 11, a discharge end 13 that delivers the appropriate air/gas mixture to a boiler or other combustion system (not shown) in the optimum quantities. The inlet 11 includes a metal portion 15 and replaceable plastic molded parts 17 and 23, all described in detail below. Metal portion 15 forms concave surface 19. Molden part 23 formes a convex surface 21 forming part of the throttle 23. Molden part 17 fits between surfaces 19 and 21.

Discharge end 13 includes a conical surface 25 extending from first convex surface 21 to a second convex surface 27 at the outlet end 29 of discharge 13. The remaining parts of valve 10 is a conventional gas supply unit 30 for supplying gas to the gas inlet described below and controlled by throttle 23.

As noted above, the mixing valve 10 of this invention functions by adjusting the proportion of gas and air using the principles of venturi action. The terms "convex" and "concave" as used above are, of course, surfaces of the cross section with respect to said central axis 31 of FIG. 3.

Figure 2:
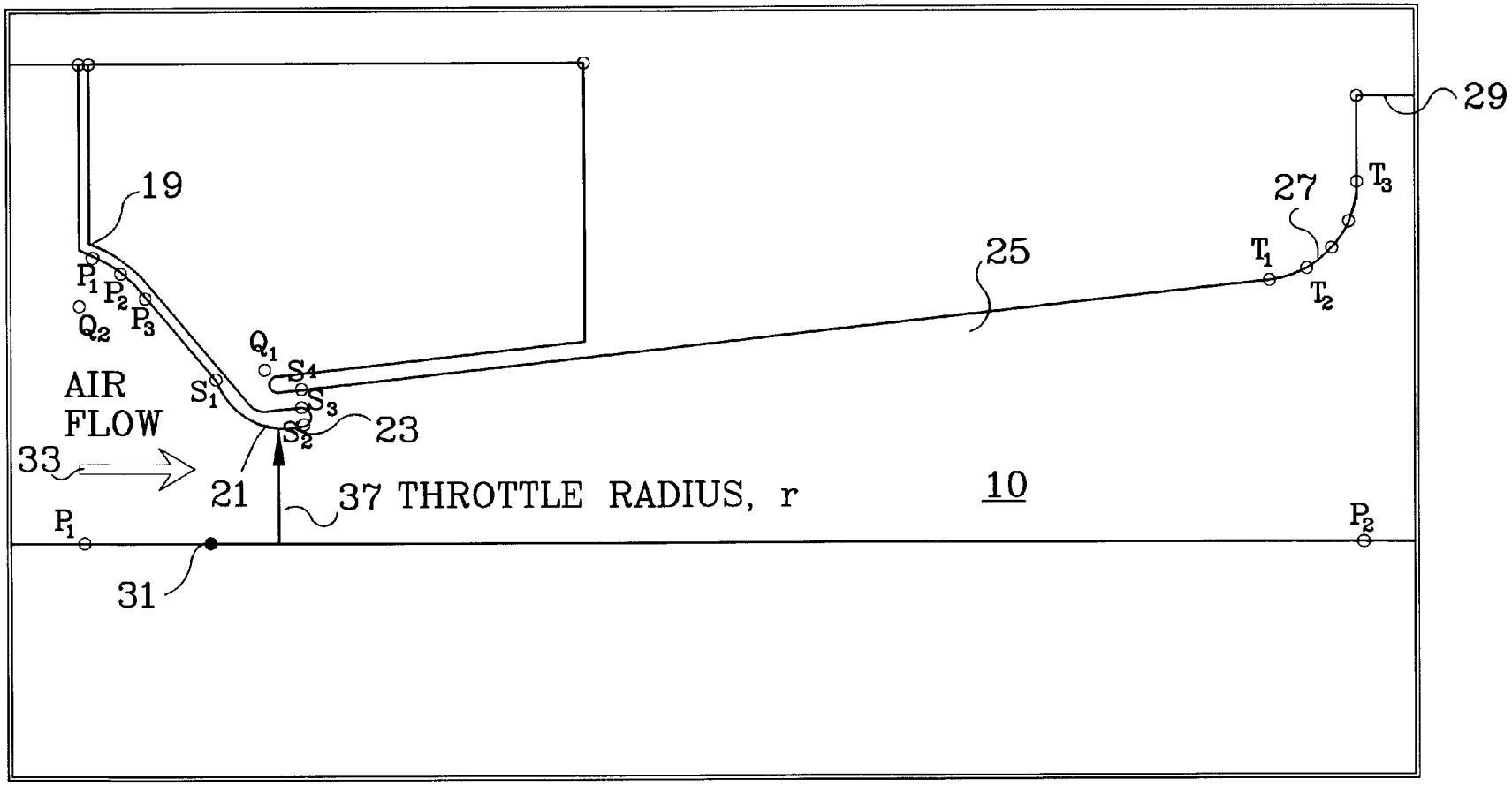
FIG. 2 is a schematic, side elevational, sectioned view of the tube valve of the present invention.
Figure 3:
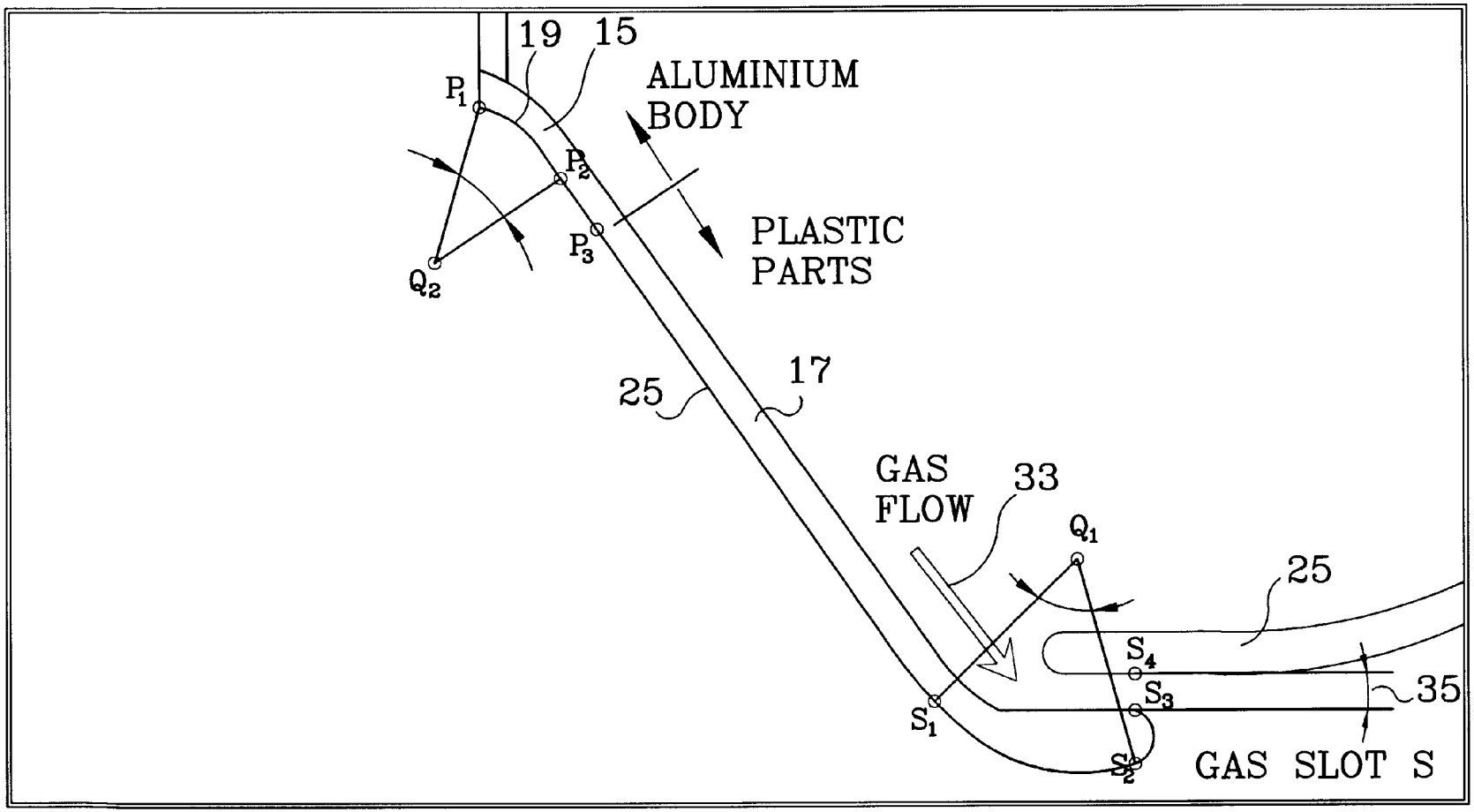
FIG. 3 is an enlarged schematic view of the inlet portion of the valve shown in FIG. 2.

Turning now to FIGS. 2 and 3, the working portions of valve 10 are shown. Valve 10 is centered about an axis 31. First concave surface 19 forms the first surface encountered by inlet air entering in the direction of arrow 33 in FIG. 2. Surface 19 is a circular segment having a center at Q2 and defining an arc between points P1 and P2, and a straight portion between P2 and P3. In the present embodiment, this arc was calculated to be about 80°.

Similarly, first convex surface 21 is a circular segment having a center at Q1 and defining an arc between points S1 and S2. In the present embodiment, this arc was calculated to be about 70°. The region between P3 and S1 is conical surface 25 of molded part 17. Curved surface 21 is also the outside of throttle 23, and throttle 23 is moveable to vary the gas inlet slot 35, which is the gap between throttle 23 and conical surface 25, to permit gas to enter via the forces in the direction of arrow 37 in FIG. 3. Gas slot s is the distance between points S3 and S4, as shown in FIG. 3.

For most applications, the metal part 15 can be standardized once the parameters of the boiler system are established. The only variable for a complete family of valves would be the molded plastic parts 17, 23, 25, 27. Conical surface 25 is at an angle with respect to the axis 31 of the valve. For the present embodiment, the angle surface 25 makes with the axis 31 is about 42°.

Of course, for significantly different operating systems, different boilers and other circumstances, a different complete family of valves would be available.

The next step is to fine tune the design for the required air and gas capacities. As has been shown, the shape profile of the inlet part is a combination of two circular surfaces and one cylindrical surface while the outlet part is a combination of one conical surface and another surface which is described pointwise and smoothed by splines. FIGS. 2 and 3 are typical asymmetrical schematics developed for the preferred embodiment but are common for any design within the scope of this invention.

One major reason why the replaceable part needs to be changed to optimize the design is that gas and air are not universally the same everywhere, and even the exact same boiler will not need the same flow when gas or air quality changes. For example, low caloric gas may be used on a ratio of gas to air of 1:10 or 1:12, for example, while high caloric gas may only require a gas to air ration of 1:15 or even higher. This is true because one needs less high caloric gas for the same heat output. Gas quality may even vary over the calendar year at a given location, because of weather, various suppliers or other factors. All that is needed is to replace the molded parts 17, 23, 25, 27 to adjust the conical surface 25, and thus the angle of surface along axis 31, which in turn has a modifying affect on the forces at the gas inlet 35, to thereby achieve uniform heat output.

It is not possible, presently, to calculate the exact air dynamics for premixing air and gas in these systems using valves to achieve the optimal proportion of gas and air. In some types of boilers, the amount of gas/air mixture being drawn into the system will vary, because of process needs and the like, to that the fan will operate at different speeds and capacities. The valve therefore must also be variable in order to provide a constant proportion of gas and air. This is done by adjusting the air flow via throttle radius 37, shown in FIG. 2, and the gas slot 35, shown in FIG. 3.

Figure 4:
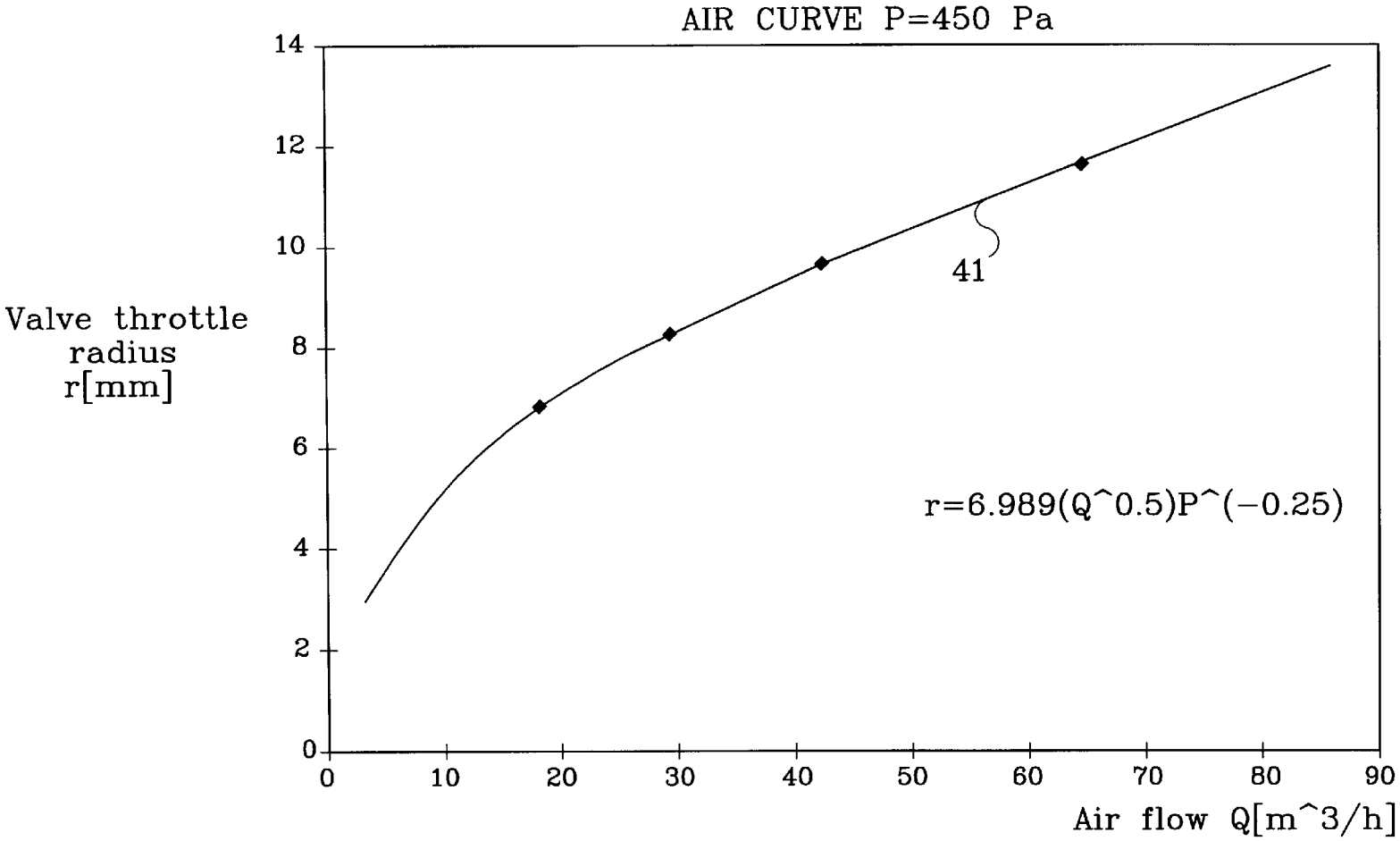
FIG. 4 is an air curve diagram illustrating the relationship between air flow and the valve throttle radius.
Figure 5:
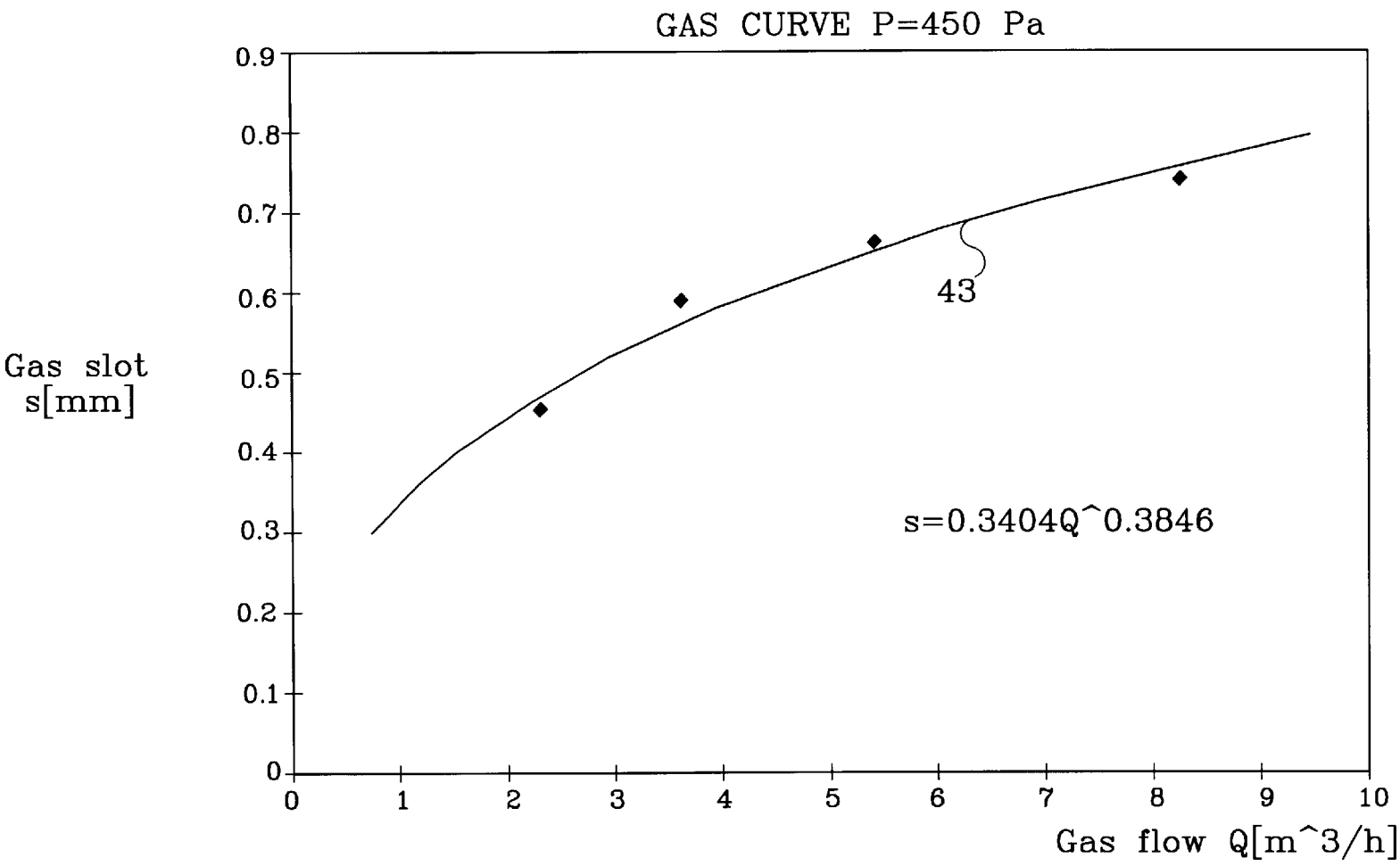
FIG. 5 is a gas curve diagram illustrating the relationship between gas flow and the gas slot size.

These two variables are determined from a series of curves, shown in FIGS. 4 and 5, and calculated using computer generated data.

Design of the inlet part of the mixing valve is a key feature. FLUENT is a computational fluid dynamics software package used in designing the inlet part of the valve. This software provides for analysis and the visualization of gas and air flow characteristics. FLUENT is made by Fluent, Inc. located in Centerra Resource Park, Lebanon, N.H. The version used for the calculations for the invention herein was FLUENT version 4.25. Fluent is software package for simulation of the fluid/gas flow in various geometry configurations. It allows physical modeling. Other fluid flow simulation software would give the same results, since what is being calculated is the desired air and gas flow to complete the combustion most efficiently.

To be able to simulate the air/gas flow inside a valve, one has to input many other values as an input values into the program such as FLUENT. These include: densities of the air/gas mixture, binary diffusivity coefficients, wall roughness, air/gas temperatures, and many other values that are set out in the program. However, any fluid flow simulation software would give the same results.

The resulting values which were used for generating of the above mentioned dependencies were flow [$m^3$/h], the geometry values of the throttle radius and gas slot [mm] and the pressure drop [pa]. The resulting curves shown in FIGS. 4 and 5 are a result of the Excel software on PC—it is only a power regression. FLUENT software has been used for the modeling and simulation of the gas/airflow inside the valve but any other software of this kind can do the same.

Based on a FLUENT simulation, one analytical description of the valve can be put in the form of two curves. FIG. 4 is the first curve, which describes the dependence of the valve's throttle radius on the air capacity (i.e., the air curve given of FIG. 4). The second curve indicates the gas slot dimension for a given gas flow (i.e., the gas curve of FIG. 5. The air curve is common for the whole range of capacities and pressure losses. The gas curve changes slightly from one given pressure drop to another, and may be determined for each particular pressure drop characteristic, or, alternatively, for at several selected neighboring pressure drops (e.g., values 350, 450 and 550 Pascals) of which other characteristics are determined from interpolated values between them.

The software program, FLUENT or another similar program, is inputted with information concerning the geometry of the valve, as well as desired air flow (discharge) [$m^3$/h], gas flow (discharge), [$m^3$/h] pressure drop along the valve [pa], valve throttle radius [mm], and gas slot width [mm].

As can be seen in FIG. 4, a curve 41 has been generated over a range of air flow in $m^3$/h of from about 10 to 66 $m^3$/h and extrapolated to the ends of curve 41 as shown. The air flow is plotted against the needed valve throttle radius to achieve the required air flow. The data developed for FIG. 4 is for a prescribed pressure drop of 450 Pascals because that value too was considered to be ideal for the system in use. One now selects the desired air flow to determine the specific throttle radius that will produce optimum operation.

This air curve is common for the whole range of capacities and pressure losses for the system being considered. The software will generate a similar curve for any system over any range of desired air flow, and thus FIG. 4 is needed to optimize the invention.

The gas curve shown in FIG. 5 changes with the given pressure drop and is to be determined (from the software) for each particular case separately, or alternatively, for at least two selected neighboring pressure drops. Values of 350 and 550 Pascals were used in the considered case and curve 43 was obtained by interpolating between those two values to obtain a curve at 450 Pascals. One now selects the desired gas flow to obtain the required gas slot size that will produce optimum operation.

The advantage of the present invention is that it eliminates the prior trial and error method. For each trial, both inlet and outlet plastic parts, mounted in an aluminum body, had to be completely manufactured. This requirement made the design process itself very slow and expensive. More critical is that the efficiency of the developed shape was not always satisfactory. Now, using the present invention, it is possible to achieve optimal computer provided efficiency and incorporates the integration of the inlet part with the aluminum body that does not change over a whole intended production range of various valve capacities and pressure drops.

An optimized air/gas mixing valve based on the above-noted approach has been verified by experimental data collected on an evaluated prototype valve designed from computer-predicted values. The experimental data that was collected on the prototype fully confirmed computer predicted values. An advantage of this is that the valve manufacturer is able to react very promptly on various customer's requirements.

While particular embodiments of the present invention have been illustrated and described, it is not intended to limit the invention, except as defined by the following claims.

I claim:

1. A gas-air mixing valve using a tube, comprising:

a valve having a central axis and an internal geometry shape for directing the flow of air and gas, said valve having an air inlet, an inlet part from the inlet to a throttle, a gas inlet slot proximate said throttle, and an outlet;

said inlet part having a first body part and a replaceable molded part;

said first body part having inlet surface centered about said central axis of said valve and being defined with respect to said axis by a concave surface having a first circular cross section at said air inlet; said replaceable molden part being a composition of a conical surface having a linear cross section and further having a convex surface, said convex surface having a second circular cross section forming the said throttle;

an replaceable outlet part having a composite outlet surface defined with respect to said axis by a first conical surface extending from said second circular cross section to a second convex surface at said outlet.

2. The valve of claim 1, wherein said throttle has a radius with respect to said central axis of said valve defined by the relationship between the desired air flow and radius for a particular pressure drop.

3. The valve of claim 2, wherein said relationship is determined by a computer simulation using parameters of the system for which the valve is intended to be used.

4. The valve of claim 2, wherein said gas slot has a thickness with respect to the desired gas flow defined by the relationship between the desired gas flow and gas slot for a particular pressure drop.

5. The valve of claim 4, wherein said relationship is determined by a computer simulation using parameters of the system for which the valve is intended to be used.

6. The valve of claim 1, wherein said body part is aluminum and said molded part is plastic.

7. In a gas-air mixing valve using a tube in which air entering said valve via an air inlet draws gas from a gas inlet around the periphery of said entering air, an inlet device comprising:

an inlet part with a shape profile in cross section defined by an inlet circular surface leading to a straight surface that terminates in a second inlet circular surface at a point proximate said gas inlet; and an outlet part having a shape profile in cross section comprising one conical surface extending from the second inlet circular surface of said inlet to a discharge end curved surface engaging said discharge end.

8. The valve of claim 7, wherein said throttle has a radius with respect to said central axis of said valve defined by the relationship between the desired air flow and radius for a particular pressure drop, said relationship being computer simulated using parameters of the system for which the valve is intended to be used.

9. The valve of claim 7, wherein said gas slot has a thickness with respect to the desired gas flow defined by the relationship between the desired gas flow and gas slot for a particular pressure drop, said relationship being computer simulated using parameters of the system for which the valve is intended to be used.

10. The valve of claim 7, wherein said inlet part includes an aluminum body part and a plastic molded part.

11. A gas-air mixing valve using a tube and having a predetermined air and gas capacity, comprising:

a throttle for adjustably controlling the quantity of gas introduced into said tube;

a valve having internal geometry shape for directing the flow of air to said tube, said valve having an inlet part and an outlet part;

said inlet part having a body part and a replaceable molded part; said first body part having an inlet surface centered about a central axis of said body part and being defined with respect to said axis by a concave surface having a first circular cross section; said replaceable molden part having a composite conical surface having a linear cross section and further defined with respect to said axis by a convex surface having a second circular cross section; and said replaceable molded outlet part having a composite outlet surface defined by a first conical surface extending from said second circular cross section to a second convex surface.

12. The valve of claim 11, wherein said throttle has a radius with respect to said central axis of said valve defined by the relationship between the desired air flow and radius for a particular pressure drop, said relationship being computer simulated using parameters of the system for which the valve is intended to be used.

13. The valve of claim 11, wherein said gas slot has a thickness with respect to the desired gas flow defined by the relationship between the desired gas flow and gas slot for a particular pressure drop, said relationship being computer simulated using parameters of the system for which the valve is intended to be used.

14. The valve of claim 11, wherein said body part is aluminum and said molded part is plastic.

* * * * *